US007883195B2

(12) United States Patent
Fairchild et al.

(10) Patent No.: US 7,883,195 B2
(45) Date of Patent: Feb. 8, 2011

(54) SOLID INK STICK FEATURES FOR PRINTER INK TRANSPORT AND METHOD

(75) Inventors: Michael Alan Fairchild, Vancouver, WA (US); Ernest Isreal Esplin, Sheridan, OR (US)

(73) Assignee: Xerox Corporation, Norwalk, CT (US)

( * ) Notice: Subject to any disclaimer, the term of this patent is extended or adjusted under 35 U.S.C. 154(b) by 719 days.

(21) Appl. No.: 11/602,710

(22) Filed: Nov. 21, 2006

(65) Prior Publication Data

US 2008/0117264 A1 May 22, 2008

(51) Int. Cl.
*B41J 2/175* (2006.01)

(52) U.S. Cl. ..... 347/88

(58) Field of Classification Search ..... 347/88, 347/99

See application file for complete search history.

(56) References Cited

U.S. PATENT DOCUMENTS

| | | | | |
|---|---|---|---|---|
| 3,656,360 | A | 4/1972 | Fix | |
| 3,773,069 | A | 11/1973 | Rebentisch | |
| 4,636,803 | A | 1/1987 | Mikalsen | |
| 4,682,187 | A | 7/1987 | Martner | |
| 5,123,961 | A | 6/1992 | Yamamoto | |
| 5,181,049 | A | 1/1993 | Mackay et al. | |
| 5,223,860 | A * | 6/1993 | Loofbourow et al. | 347/88 |
| 5,276,468 | A | 1/1994 | Deur et al. | |
| 5,341,164 | A | 8/1994 | Miyazawa et al. | |
| 5,379,915 | A | 1/1995 | Hudspeth et al. | |
| 5,386,224 | A | 1/1995 | Deur et al. | |
| 5,442,387 | A | 8/1995 | Loofbourow et al. | |
| 5,510,821 | A | 4/1996 | Jones et al. | |
| D371,157 | S | 6/1996 | Chambers | |
| D371,801 | S | 7/1996 | Jones et al. | |
| D371,802 | S | 7/1996 | Jones et al. | |
| D372,268 | S | 7/1996 | Jones et al. | |
| D372,270 | S | 7/1996 | Jones et al. | |
| D373,139 | S | 8/1996 | Jones et al. | |
| D379,470 | S | 5/1997 | Gilbert | |
| D379,471 | S | 5/1997 | Gilbert | |
| D379,639 | S | 6/1997 | Gilbert | |

(Continued)

FOREIGN PATENT DOCUMENTS

EP 0683051 A2 11/1995

(Continued)

OTHER PUBLICATIONS

Non-Final Office Action for U.S. Appl. No. 11/602,931 Mailed Jun. 9, 2009, United States and Trademark Office (21 pages).

(Continued)

*Primary Examiner*—Anh T. N. Vo
(74) *Attorney, Agent, or Firm*—Maginot, Moore & Beck LLP

(57) ABSTRACT

A solid ink stick adapted for use with solid ink printers is provided. The stick includes a body defining a longitudinal axis of the body. The body defines an external periphery of the body. The external periphery has a groove formed on the periphery. The groove extends in a direction generally along the longitudinal axis of the body and at least a portion of the groove length is non linear.

8 Claims, 15 Drawing Sheets

U.S. PATENT DOCUMENTS

D379,640 S 6/1997 Gilbert
D380,771 S 7/1997 Jones
D383,153 S 9/1997 Jones et al.
D383,154 S 9/1997 Jones et al.
5,689,288 A 11/1997 Wimmer et al.
5,734,402 A 3/1998 Rousseau et al.
5,784,089 A 7/1998 Crawford
D402,308 S 12/1998 Yao et al.
D403,351 S 12/1998 Yao et al.
D403,352 S 12/1998 Brown et al.
D403,699 S 1/1999 Chin et al.
5,861,903 A 1/1999 Crawford et al.
D407,109 S 3/1999 Yao et al.
D407,110 S 3/1999 Yao et al.
D407,111 S 3/1999 Brown et al.
D407,742 S 4/1999 Yao et al.
D407,743 S 4/1999 Yao et al.
D407,745 S 4/1999 Brown et al.
D408,849 S 4/1999 Chin et al.
D409,235 S 5/1999 Chin et al.
D409,237 S 5/1999 Ellers et al.
D410,026 S 5/1999 Brown et al.
D410,490 S 6/1999 Mattern et al.
5,917,528 A 6/1999 Grellmann et al.
D412,527 S 8/1999 Ellers et al.
D412,528 S 8/1999 Ellers et al.
D412,934 S 8/1999 Jones
D413,625 S 9/1999 Brown et al.
D414,200 S 9/1999 Jones
D415,193 S 10/1999 Jones
D416,936 S 11/1999 Chin et al.
5,975,690 A 11/1999 Grellmann et al.
5,988,805 A 11/1999 Meinhardt
6,053,608 A 4/2000 Ishii et al.
6,056,394 A 5/2000 Rousseau et al.
6,109,803 A 8/2000 Yasui et al.
D436,124 S 1/2001 Mattern et al.
D436,989 S 1/2001 Mattern et al.
6,170,942 B1 1/2001 Ogawa et al.
D440,248 S 4/2001 Mattern et al.
D440,249 S 4/2001 Ellers, Jr. et al.
D453,786 S 2/2002 Mattern
D453,787 S 2/2002 Mattern
6,422,694 B1 7/2002 Hollands
6,543,867 B1 4/2003 Jones
6,561,636 B1 5/2003 Jones
6,565,200 B1 5/2003 Jones
6,565,201 B1 5/2003 Jones
6,572,225 B1 6/2003 Jones
D478,347 S 8/2003 Jones
D478,621 S 8/2003 Jones
D479,368 S 9/2003 Jones
D481,757 S 11/2003 Jones
D481,758 S 11/2003 Jones
D481,759 S 11/2003 Jones et al.
D482,062 S 11/2003 Jones
D482,063 S 11/2003 Jones et al.
D482,388 S 11/2003 Jones
D482,389 S 11/2003 Jones
D482,720 S 11/2003 Jones et al.
D482,721 S 11/2003 Jones
D482,722 S 11/2003 Jones
6,648,435 B1 11/2003 Jones
D483,062 S 12/2003 Jones
D483,063 S 12/2003 Jones
D483,404 S 12/2003 Jones et al.
6,672,716 B2 1/2004 Jones
6,679,591 B2 1/2004 Jones
6,705,710 B2 3/2004 Jones et al.
6,709,094 B2 3/2004 Jones
6,719,413 B2 4/2004 Jones
6,719,419 B2 4/2004 Jones et al.
6,722,764 B2 * 4/2004 Jones et al. ..... 347/88
6,739,713 B2 5/2004 Jones et al.
6,746,113 B1 6/2004 Leighton et al.
6,755,517 B2 6/2004 Jones et al.
6,761,443 B2 7/2004 Jones
6,761,444 B2 7/2004 Jones et al.
6,772,764 B2 8/2004 Chapman
6,824,241 B2 11/2004 Sonnichsen et al.
D500,784 S 1/2005 Jones et al.
D500,785 S 1/2005 Jones et al.
6,840,612 B2 1/2005 Jones et al.
6,840,613 B2 1/2005 Jones
6,857,732 B2 2/2005 Jones et al.
6,866,375 B2 3/2005 Leighton et al.
6,874,880 B2 4/2005 Jones
6,893,121 B2 5/2005 Jones
6,895,191 B2 5/2005 Rommelmann et al.
D505,974 S 6/2005 Jones et al.
6,905,201 B2 6/2005 Leighton
6,929,360 B2 8/2005 Jones
6,966,644 B2 11/2005 Jones et al.
6,981,754 B2 1/2006 Godil et al.
6,986,570 B2 1/2006 Jones et al.
7,063,412 B2 6/2006 Jones et al.
7,066,589 B2 6/2006 Jones et al.
D524,370 S 7/2006 Jones et al.
7,104,635 B2 9/2006 Jones
D531,210 S 10/2006 Jones
D535,327 S 1/2007 Korn et al.
D535,689 S 1/2007 Jones et al.
D537,116 S 2/2007 Jones et al.
2003/0202066 A1 10/2003 Jones
2003/0202067 A1 10/2003 Jones et al.
2003/0202069 A1 10/2003 Jones
2003/0202070 A1 10/2003 Jones
2003/0202071 A1 10/2003 Jones et al.
2003/0202074 A1 10/2003 Jones
2003/0202075 A1 10/2003 Jones
2003/0202077 A1 10/2003 Jones et al.
2003/0222930 A1 12/2003 Jones
2003/0222951 A1 12/2003 Jones
2003/0222952 A1 12/2003 Jones
2003/0222953 A1 12/2003 Jones
2003/0222954 A1 12/2003 Jones et al.
2003/0222955 A1 12/2003 Jones
2004/0160498 A1 8/2004 Jones
2004/0179074 A1 9/2004 Jones et al.
2004/0183875 A1 9/2004 Jones et al.
2005/0007428 A1 1/2005 Joppen
2005/0063820 A1 3/2005 Awdalla
2005/0146584 A1 7/2005 Godil et al.
2005/0151814 A1 7/2005 Wong et al.
2006/0227193 A1 10/2006 Leighton
2007/0153068 A1 7/2007 Jones et al.
2008/0088688 A1 4/2008 Jones et al.
2008/0122907 A1 5/2008 Jones

FOREIGN PATENT DOCUMENTS

EP 1122075 A1 8/2001
EP 1359019 11/2003
JP 11-1115213 4/1999

OTHER PUBLICATIONS

Amendment in Response to Non-Final Office Action for U.S. Appl. No. 11/602,931, submitted Sep. 8, 2009 (17 pages).
Final Office Action for U.S. Appl. No. 11/602,931 Mailed Jan. 5, 2010, United States Patent and Trademark Office (21 pages).
Amendment accompanying a Request for Continued Examination for U.S. Appl. No. 11/602,931, submitted Apr. 5, 2010 (9 pages).
Non-Final Office Action for U.S. Appl. No. 11/602,937 Mailed Sep. 21, 2009, United States Patent and Trademark Office (7 pages).

Amendment in Response to Non-Final Office Action for U.S. Appl. No. 11/602,937, submitted Dec. 21, 2009 (8 pages).
Final Office Action for U.S. Appl. No. 11/602,937 Mailed Apr. 14, 2010, United States Patent and Trademark Office (8 pages).
Amendment accompanying a Request for Continued Examination for U.S. Appl. No. 11/602,937, submitted Apr. 23, 2010 (9 pages).
Non-Final Office Action for U.S. Appl. No. 11/602,938 Mailed Aug. 7, 2009, United States Patent and Trademark Office (10 pages).
Amendment in Response to Non-Final Office Action for U.S. Appl. No. 11/602,938, submitted Sep. 2, 2009 (29 pages).
Non-Final Office Action for U.S. Appl. No. 11/602,943 Mailed Jun. 25, 2009, United States Patent and Trademark Office (7 pages).
Amendment in Response to Non-Final Office Action for U.S. Appl. No. 11/602,943, submitted Sep. 24, 2009 (13 pages).
Final Office Action for U.S. Appl. No. 11/602,943 Mailed Jan. 21, 2010, United States Patent and Trademark Office (9 pages).
Amendment accompanying a Request for Continued Examination for U.S. Appl. No. 11/602,943, submitted Mar. 22, 2010 (10 pages).
Second Non-Final Office Action for U.S. Appl. No. 11/602,943 Mailed Apr. 14, 2010, United States Patent and Trademark Office (5 pages).
Amendment in Response to second Non-Final Office Action for U.S. Appl. No. 11/602,943, submitted Apr. 23, 2010 (10 pages).
International Search Report in corresponding European Application No. 07120873.0 mailed May 19, 2008 (9 pages).
International Search Report in corresponding European Application No. 07120873.0 mailed Mar. 4, 2008 (5 pages).
Second Non-Final Office Action for U.S. Appl. No. 11/602,931, United States Patent & Trademark Office , Mailed Jun. 22, 2010 (9 pages).

* cited by examiner

SOLID INK STICK FEATURES FOR PRINTER INK TRANSPORT AND METHOD

1. CROSS-REFERENCE TO RELATED APPLICATIONS

Cross reference is made to the following applications: U.S. patent application Ser. No. 11/602,943, which is entitled "Transport System for Solid Ink in a Printer", U.S. patent application Ser. No. 11/602,931, which is entitled "Printer Solid Ink Transport and Method", U.S. patent application Ser. No. 11/602,937, which is entitled "Guide For Printer Solid Ink Transport and Method", and U.S. patent application Ser. No. 11/602,938, which is entitled "Transport System for Solid Ink for Cooperation with Melt Head in a Printer", all of which were filed concurrently herewith and which are incorporated herein by reference.

2. TECHNICAL FIELD

The solid ink sticks described herein generally relate to high speed printers which have one or more printheads that receive molten ink heated from solid ink sticks or pellets. More specifically, the solid ink sticks relate to improving the ink transport system design and functionality.

3. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages solid ink sticks which remain in solid form at room temperatures. The ink stick can be refilled by a user by simply adding more ink as needed to the ink loader 110. Separate loader channels are used for the different colors. For, example, only black solid ink is needed for monochrome printing, while solid ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink.

In typical prior art solid ink loaders, the ink sticks are positioned end to end in a channel or chute with a melt device on one end and a spring biased push block on the other end. This configuration requires the operator to manually advance the ink in the chute to provide space to insert additional ink sticks, to the extent there is capacity in the channel. This configuration may be somewhat cumbersome for loading large quantities of ink sticks in newer, larger capacity and faster printing products, as the operator has to repeatedly insert an ink stick and then push it forward manually when loading multiple ink sticks in the same channel.

Another issue is that the spring biased push block mechanism limits the amount of ink that can be stored in each channel. Extended capacity loaders with greater length require longer, higher force springs so the push block mechanism can become prohibitably bulky and expensive. Closing an access cover in opposition to the greater spring force needed for larger amounts of ink can be inconvenient or unacceptable to the user during the ink loading process.

Also, the spring biased push block pushes the ink from the back of the ink sticks, which may lead to undesirable steering or reorienting of the ink. Pushing larger sticks, particularly a longer stack of ink sticks from the back of a stick can lead to buckling and jamming of the sticks. Jamming is more pronounced when there is high feed friction. To minimize friction, a lubricious tape or similar non-stick surface is often used, adding additional cost to the product.

4. SUMMARY

In view of the above-identified problems and limitations of the prior art and alternate ink and ink loader forms, a solid ink stick (defined here to include even a single or partial ink stick) is provided that is adapted for use with solid ink printers that have a driver.

In one embodiment, a solid ink stick adapted for use with solid ink printers is provided. The stick includes a body defining a longitudinal axis of the body. The body defines an external periphery of the body. The external periphery has a groove formed on the periphery. The groove extends in a direction generally along the longitudinal axis of the body and at least a portion of the groove length is non linear.

In another embodiment, a solid ink delivery system for use in solid ink printers is provided. The delivery system includes a guide for guiding the ink stick in a prescribed path and a solid ink stick. The stick is slidably fitted to the guide. The stick has a body defining a longitudinal axis of the body. The body defines an external periphery of the body. The external periphery has a groove formed on periphery. The groove extends in a direction generally along the longitudinal axis of the body and at least a portion of the groove length is non linear. The delivery system also includes a drive member for engagement with the solid ink stick. The drive member extends along a substantial portion of the prescribed path of the guide.

In another embodiment, a solid ink printer for use with a solid ink delivery system is provided. The delivery system includes a guide for guiding the solid ink stick in a prescribed path and a solid ink stick. The stick is slidably fitted to the guide. The stick has a body defining a longitudinal axis of the body. The body defines an external periphery of the body. The external periphery has a groove formed on periphery. The groove extends in a direction generally along the longitudinal axis of the body and at least a portion of the groove length is non linear. The delivery system also includes a drive member for engagement with the solid ink stick. The drive member extends along a substantial portion of the prescribed path of the guide.

The ink sticks described herein are for an ink delivery system for solid ink printers that uses a driver, for example in the form of a stick with a groove to receive a belt to advance the ink from the loading station to the melting station where molten ink can be transferred to one or more printheads. The many additional described features of this ink delivery system, which can be selectively incorporated individually or in any combination, enable many additional printer system opportunities, including lower cost, enlarged ink storage capacity, as well as, more robust feed reliability.

5. BRIEF DESCRIPTION OF THE DRAWINGS

Features of the ink sticks described herein will become apparent to those skilled in the art from the following description with reference to the drawings, in which.

6. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of intermediate connections, tubes, manifolds, heaters and/or other components that may be involved in a printing system but are not immediately significant to the ink sticks described herein.

The general components of a solid ink printer have been described supra. The solid ink sticks disclosed herein includes a solid ink stick and a solid ink delivery system and a solid ink printer for incorporating the same.

Figure 1:
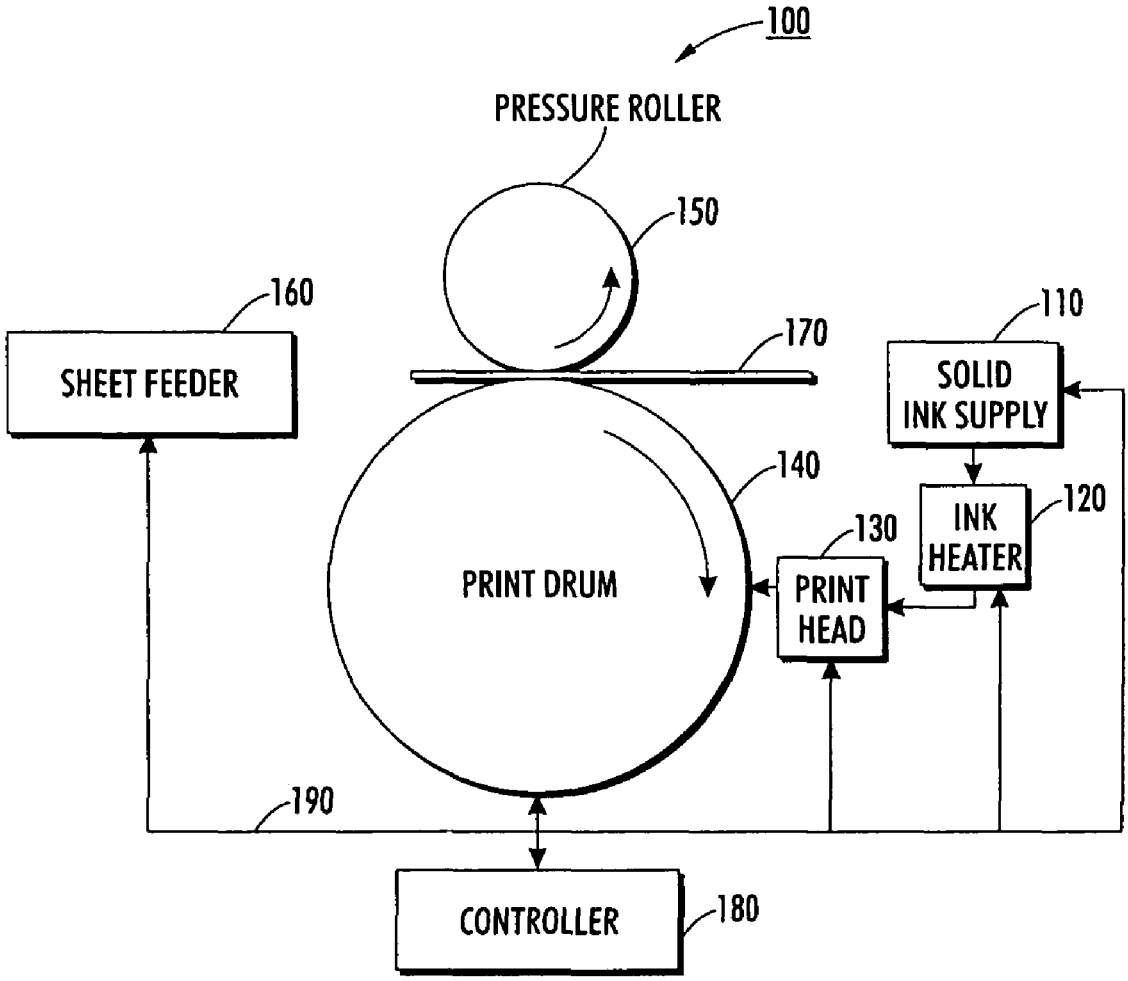
FIG. 1 PRIOR ART
FIG. 1 is a general schematic diagram of a prior art high speed, solid ink printer.
Figure 2:
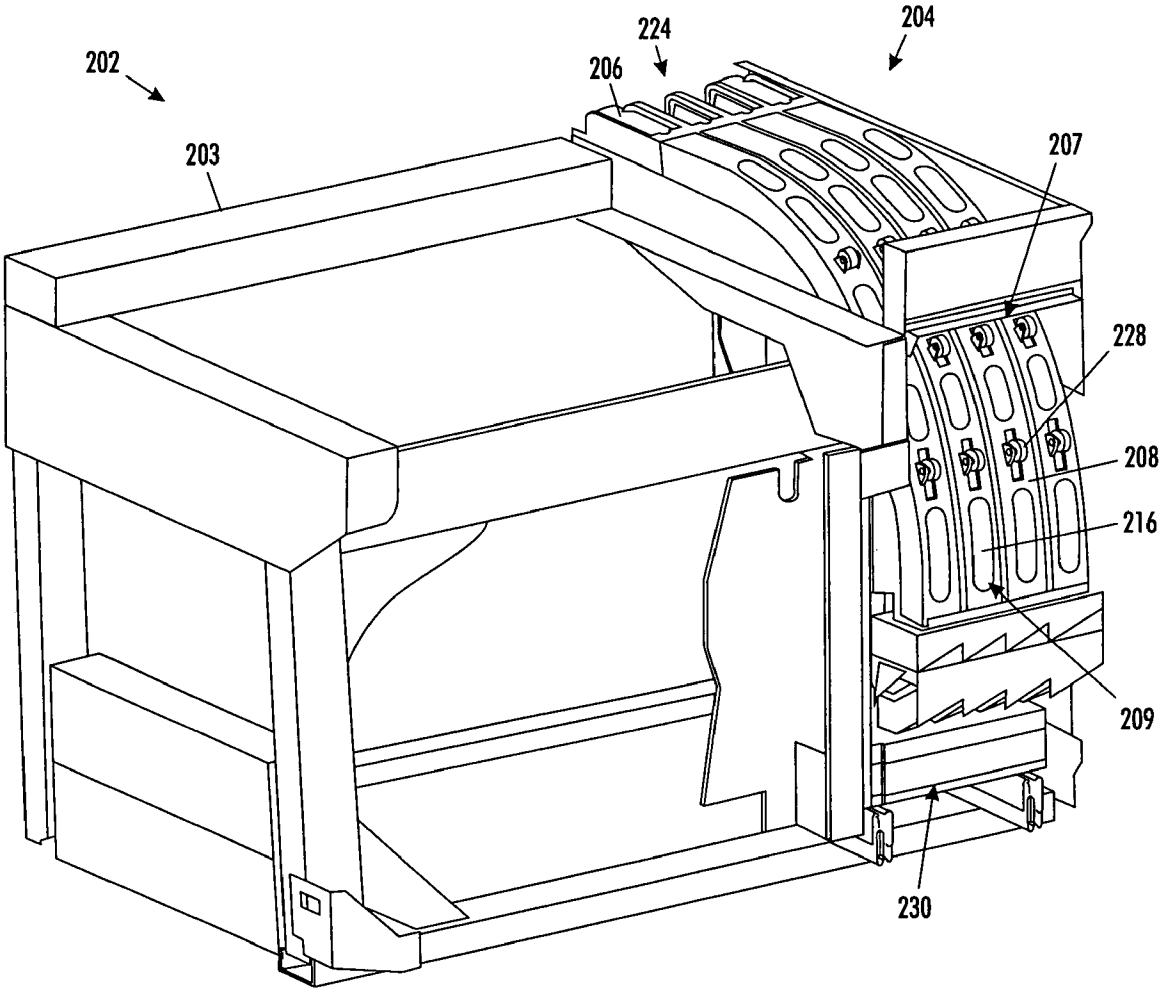
FIG. 2 is a partial cutaway perspective view of the solid ink delivery system in position in a solid ink printer for delivering solid ink sticks to printheads of the printer.

Referring now to FIG. 2, an embodiment of the solid ink printer with the solid ink delivery system is shown as solid ink printer 202. The printer 202 is a multi-color printer. The printer 202 utilizes four separate color ink sticks 206 which have, respectively, the colors black, cyan, magenta and yellow. The printer 202 of FIG. 2 also has a chute 208 that includes an arcuate portion 207. The arcuate portion may be comprised of a single or multiple arc axes, including continuously variable 3 dimensional arc paths, any combination of which can be of any length relative to the full arcuate portion. The term arcuate refers to these and any similar, non linear configuration. It should be appreciated that a solid ink color printer may be designed without a chute having an arcuate portion.

The printer 202, as shown in FIG. 2, has a frame 203 which is used to support the ink delivery system 204. The ink delivery system 204 advances the sticks 206 from loading station 224 near the top of the printer 202 to melting station 230 near the bottom of the printer 202. The ink delivery system 204 incorporates four solid ink delivery sub-systems, each consisting, in part, of a load or receiving section, a feed chute and a melt unit. The printer 202 includes a plurality of chutes 208. The chutes 208 may be integral with each other or each of the plurality of chutes 208 may be a separate component. A separate chute 208 is utilized for each of the four colors:

namely cyan, magenta, black and yellow. The chutes 208 are configured to contain and guide the sticks along the feed path from insertion to melt unit.

As shown in FIG. 2, the chutes 208 may include longitudinal openings 209 for viewing the progress of the sticks 206 within the chutes 208 and also to reduce cost and weight. Nudging members 228 may be positioned along the chute 208 for nudging the sticks 206 into sufficient contact with the belt 216.

Figure 3:
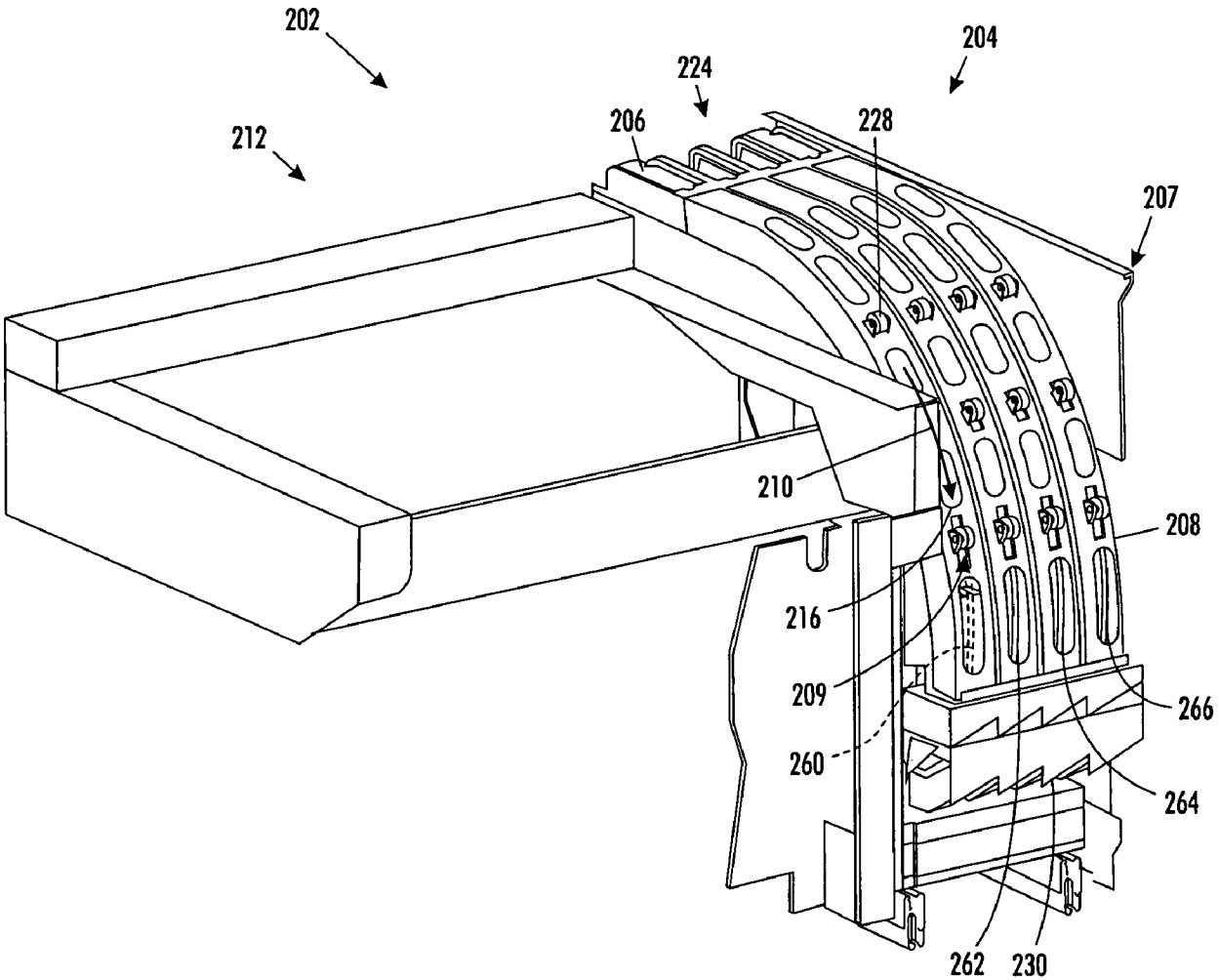
FIG. 3 is a partial cutaway perspective view of the solid ink delivery system of FIG. 2 in position in a solid ink printer for delivering solid ink sticks to print heads of the printer, showing the ink delivery system in greater detail.
Figure 8:
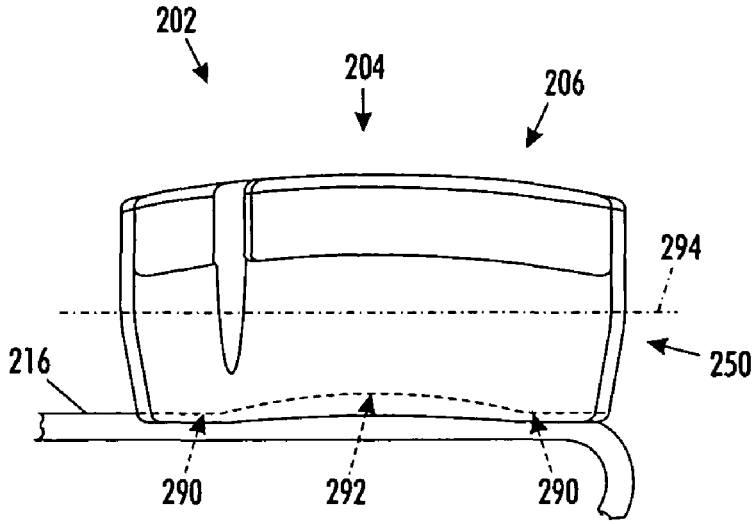
FIG. 8 is a plan view of the solid ink stick of FIG. 12 in position on a flat portion of the drive member of the guide assembly FIG. 6.

Referring now to FIG. 3, the ink delivery system 204 of the printer 202 is shown in greater detail. The ink delivery system 204 includes four separate ink delivery sub-systems The ink delivery system 204 incorporates four ink delivery sub-systems, each consisting, in part, of a load or receiving section, a feed chute and a melt unit. For example, and as is shown in FIG. 8, the ink delivery system 204 includes a black ink delivery sub-system 260.

The ink delivery system 204 further includes a second, third and fourth ink delivery sub-system 262, 264 and 266 providing for cyan, yellow and magenta ink sticks, respectively. The colors have been described in a specific sequence but may be sequenced in any order for a particular printer. Keyed insertion openings define which color will be admitted into a sub-system color chute of the ink delivery system 304.

Each of the ink delivery sub-systems 260, 262, 264 and 266 may be positioned parallel to each other and may have similar components. For simplicity, the black ink delivery sub-system 260 will be described in greater detail. It should be appreciated that the other sub-systems 262, 264 and 266 have similar components and operate similarly to the black ink delivery sub-system 260.

The black ink delivery sub-system 260 includes the guide in the form of chute 208 for holding a number of ink sticks 206 and advancing them in a prescribed path 210 from loading station 224 to the melting station 230. The chute 208 may have an insertion opening with any suitable shape such that only one color of an ink stick set may pass through the opening chute 208.

The black ink delivery sub-system 260 further includes a drive member in the form of belt 216 which provides for engagement with a plurality of the sticks 206 and extends along a substantial portion of the prescribed path 210 of the ink delivery sub-system 260. As shown in FIG. 3, the belt 216 engages more than one stick at a time. The belt 216 may simultaneously contact several sticks 206, each stick positioned at a different place in the chute.

Figure 4:
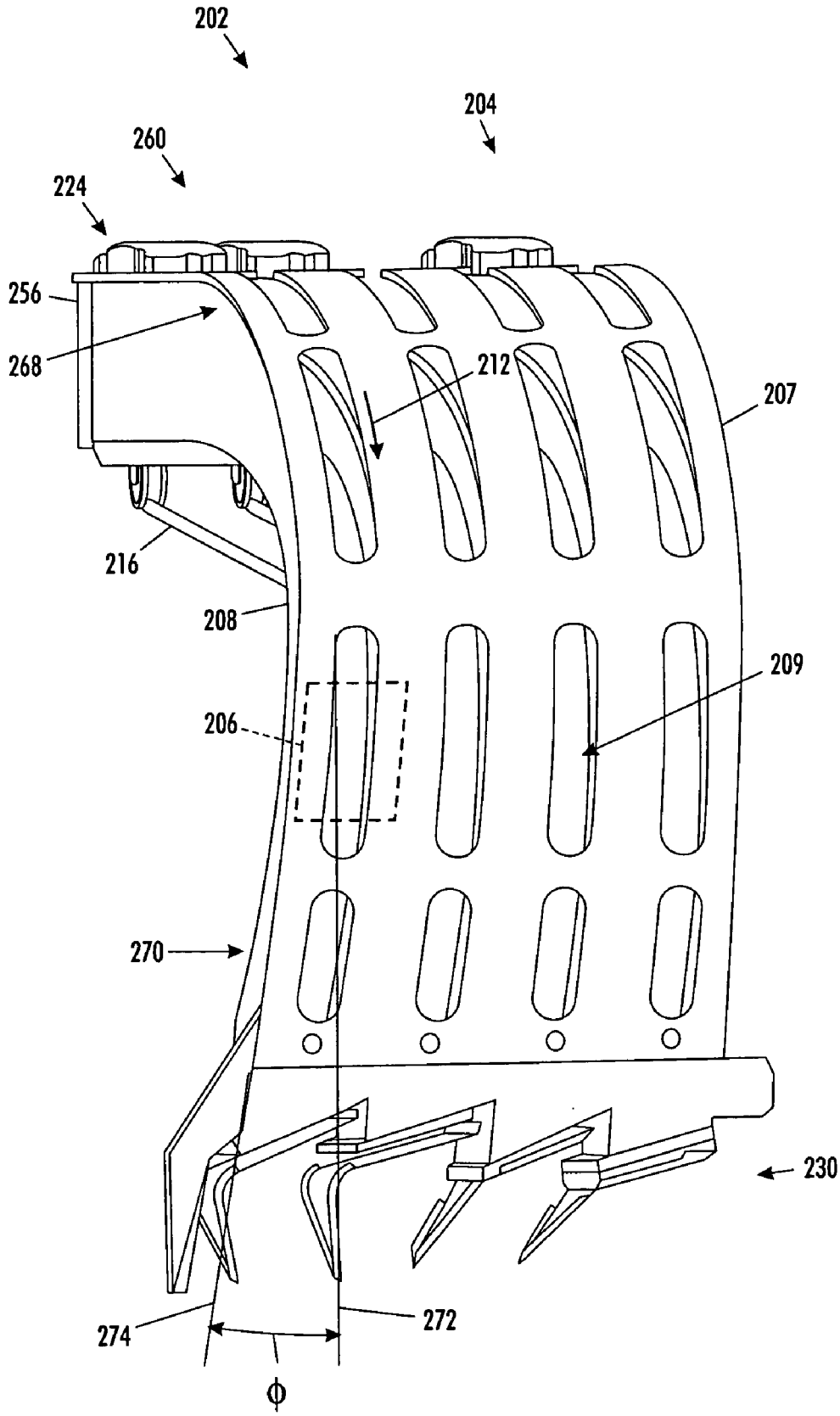
FIG. 4 is a perspective view of the guide for the ink sticks of the solid ink delivery system of FIG. 2 in position in a solid ink printer for delivering solid ink sticks to printheads of the printer.

While the chute 208 may have any suitable shape, for example, and as shown in FIG. 4, the chute 208 may include a first linear portion 268 adjacent the loading station 224. As shown in FIG. 4, the first linear portion 268 may be substantially horizontal such that the stick 206 may be inserted into the end 256 of the chute 208 in a simple horizontal motion in the top of the printer 202.

To better utilize the space within the printer 202, the chute 208 may have a shape that is not linear such that a greater number of sticks 206 may be placed within the printer 202 than the number possible with a linear chute. For example, and as shown in FIG. 4, the chute 208 may include, in addition to the first linear portion 268, arcuate portion 207 extending downwardly from the first linear portion 268 of the chute 208. The chute 208 may further include a second linear portion 270 extending downwardly from the arcuate portion 207 of the chute 208. The second linear portion 270 may be substantially vertical and be positioned over the melting station 230 such that the sticks 206 may be delivered to the melting station 230 by gravity.

Figure 9:
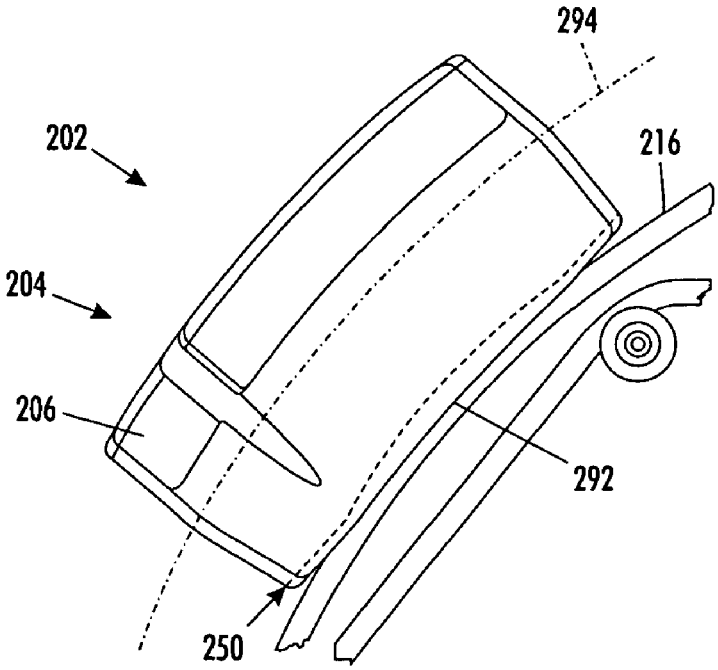
FIG. 9 is an plan view of the solid ink stick of FIG. 12 in position on a curved portion of the drive member of the guide assembly FIG. 6.

The chute may lay within a single plane, for example, plane 272. Alternatively, and as shown in FIG. 4, the chute 208 may extend through a series of non-parallel planes. For example, and as shown in FIG. 9, the chute 208 may move downwardly and outwardly to an angled plane 274 which is skewed with respect to the vertical plane 272. The planes 272 and 274 form an angle $\phi$ there between. The angle $\phi$ may be any angle capable of providing for a larger number of sticks 206 in chute 208.

Figure 5:
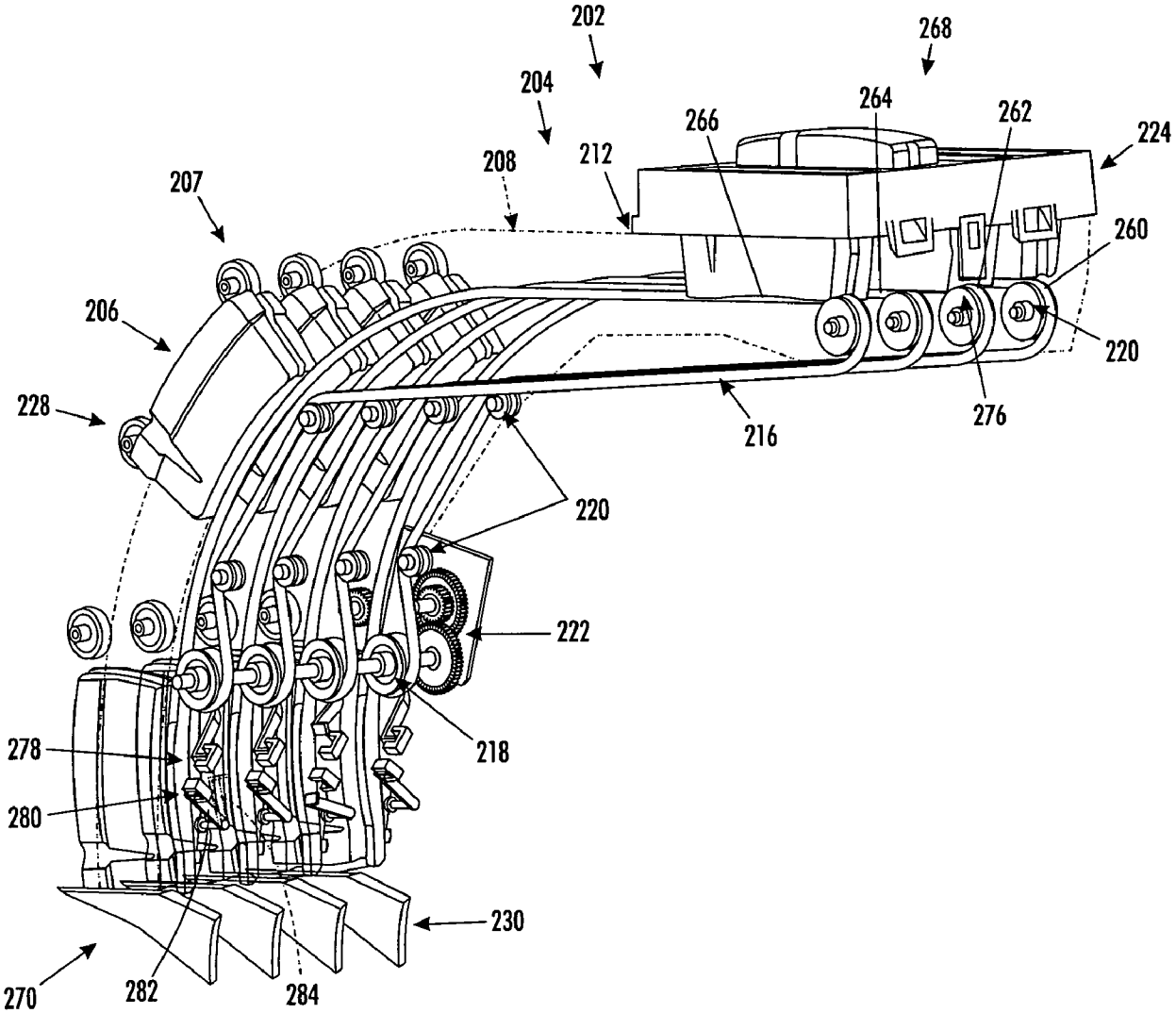
FIG. 5 is a perspective view of the guide assembly including the drive member for advancing the ink sticks of the solid ink delivery system of FIG. 2 toward the printheads of the printer.

Referring now to FIG. 5, the drive belt 216 of the ink delivery system 204 of the printer 202 is shown in greater detail. The drive belt 216 may require that a portion of the belt 216 contact the stick 206 over at least a portion of the ink stick travel range and have a shape to conform to the chute 208. The conforming shape may be in the arcuate portion 207 of the chute 208, as well as in the first linear portion 268 and the second linear portion 270 of the chute 208. The belt 216 may be driven, for example, by a motor transmission assembly 222 which is used to rotate drive pulley 218.

The drive belt 216 may, for example, have a circular cross section and be a continuous belt extending from the drive pulley 218 through at least one idler pulley 220 and chute 208. The progressive position of the drive pulley and idler pulley or pulleys relative to the belt travel direction can be in any order appropriate to chute and drive system configuration. Nudging members 228 in the form of, for example, pinch rollers may be spring loaded and biased against the belt 216 to assure sufficient friction between the belt 216 and the sticks 206 such that the sticks do not fall by gravity and slip away from the belt 216.

The belt 216 may have a constant diameter and may be sized to properly advance the sticks 206. The belt 216 may be made of any suitable, durable material. For example, the belt 216 may be made of a plastic or elastomer. If made of an elastomer, the belt 216 may be made of, for example, polyurethane.

The pulleys 218 and 220 have a similar size and shape and may include a pulley groove for receiving the belt 216. The pulley groove may be defined by a diameter similar to that of the diameter of the belt 216. The pulleys 218 and 220 are made of any suitable, durable material and may, for example, be made of a plastic. If made of a plastic, for example, the pulley may be made of Acetyl.

In order that the ink stick 206 be able to slide smoothly along the chute 208, potential contact surfaces of the chute 208 should be made of a material that provides a coefficient of friction between the internal periphery 244 of the chute 208 and the external periphery 212 of the sticks 206 that is low enough to permit the easy flow or movement of the sticks 206 in the chute 208. Conversely, the coefficient of friction between the periphery 244 of the chute 208 and the belt 216 should be sufficiently low to permit the advancement of the belt 216 within the chute belt guide 246 of the chute 208. The coefficient of friction between the belt 216 and the sticks 206 should be sufficiently high to cause the belt 216 to engage the sticks 206 and to cause the belt 216 to properly advance the sticks 206 along the chute 208. Friction values are not definite and will vary based on numerous factors of a given system, such as stick size, stick to stick interfaces, angle of travel relative to gravity and so forth.

The ink delivery system 204 of the printer 202 may further include a series of indicators or sensors for determining the presence or absence of the sticks 206 within different portions of the chute 208. An inlet sensor assembly 276 may be used to indicate additional ink sticks 206 may be added to the chute 208. The inlet sensor assembly 276 may be positioned near loading station 224. A low sensor assembly 278 may be used to indicate a low quantity of ink sticks 206 in the chute 208. The low sensor assembly 278 may be positioned spaced from the melt station 230.

An out sensor assembly 280 may be used to indicate the absence of ink sticks 206 in the chute 208. The out sensor assembly 280 may be positioned adjacent to the melt station 230. The sensor assemblies 276, 278 and 280 may have any suitable shape and may, for example, and as is shown in FIG. 5, be in the form of pivoting flags or sensors that pivot about a wall of the chute 208. The presence of a stick 206 causes the sensors to move from first position 282, as shown in phantom, to second position 284, as shown in solid. A sensor or switch may be used to determine whether the sensors 276, 278 or 280 are in the first position 282 or in the second position 284. Other sensing devices may be used in conjunction with or in place of a mechanical flag system, such as a proximity switch or reflective or retro-reflective optical sensor.

Figure 5A:
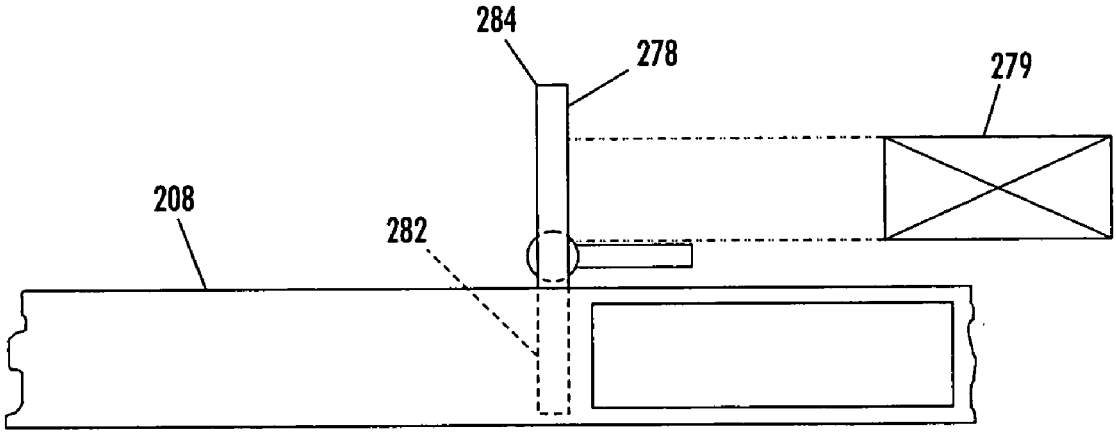
FIG. 5A is a partial plan view of a sensor in position in the guide assembly of FIG. 5.

Referring now to FIG. 5A, sensor 278 is shown in position in wall of the chute 208. The sensor 278 pivots about a wall of the chute 208 and transitions a switch, such as a micro switch or an optical interrupter. The presence of a stick 206 causes the sensor 278 to move from first position 282, as shown in phantom, to second position 284, as shown in solid. A sensor or switch 279 may be used to determine whether the sensor 278 is in the first position 282 or in the second position 284.

Figure 6:
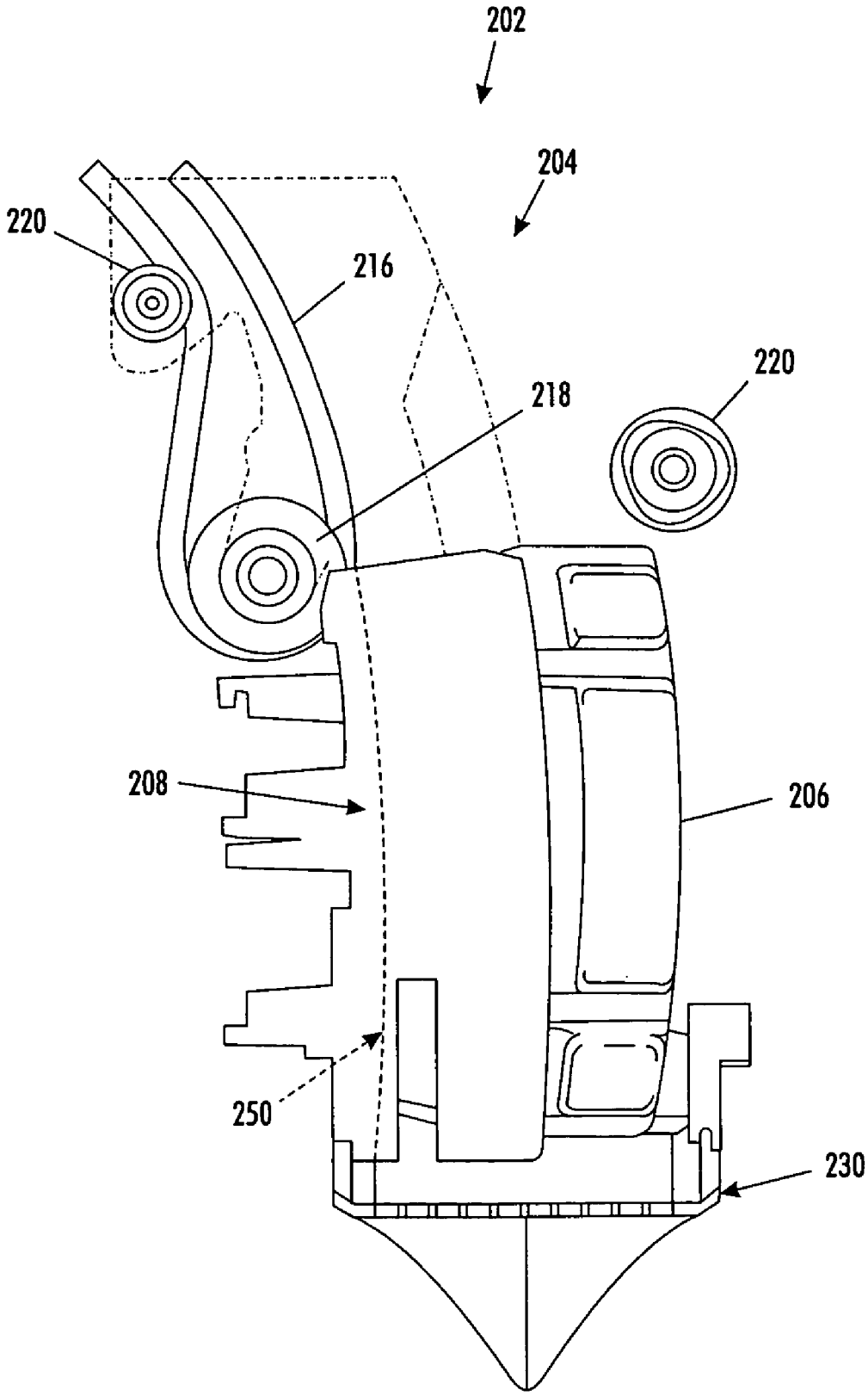
FIG. 6 is partial perspective view of the guide assembly including the drive member for advancing the ink sticks of the solid ink delivery system of FIG. 2 showing the portion adjacent the print heads in greater detail.

Referring now to FIG. 6, the ink delivery system 204 of the printer 202 is shown in the location around the melt station 230. As shown in FIG. 6, the drive pulley 218 and the belt 216 are positioned somewhat away from an ink stick 206 when the stick 206 is in the melt station 230. The spacing of the belt 216 away from the stick 206 when the stick 206 is in the melt station 230 may permit gravity to be the only factor causing the sticks 206 to be forced against a melt unit when the belt is stopped. If the belt 216 continues to run, however, additional sticks 206, if present, may contact the belt 216 and push against the lower stick 206, nudging it toward the melt station 230.

It should be appreciated that, alternatively, the pulley 218 may be positioned low enough that the stick 206 may be in contact with the pulley 218 when the stick 206 is in the melt station 230. With such a configuration, the belt 216 may ensure sufficient forces are exerted on the stick 206 to increase the contact pressure of the stick 206 against the melt unit.

Figure 7:
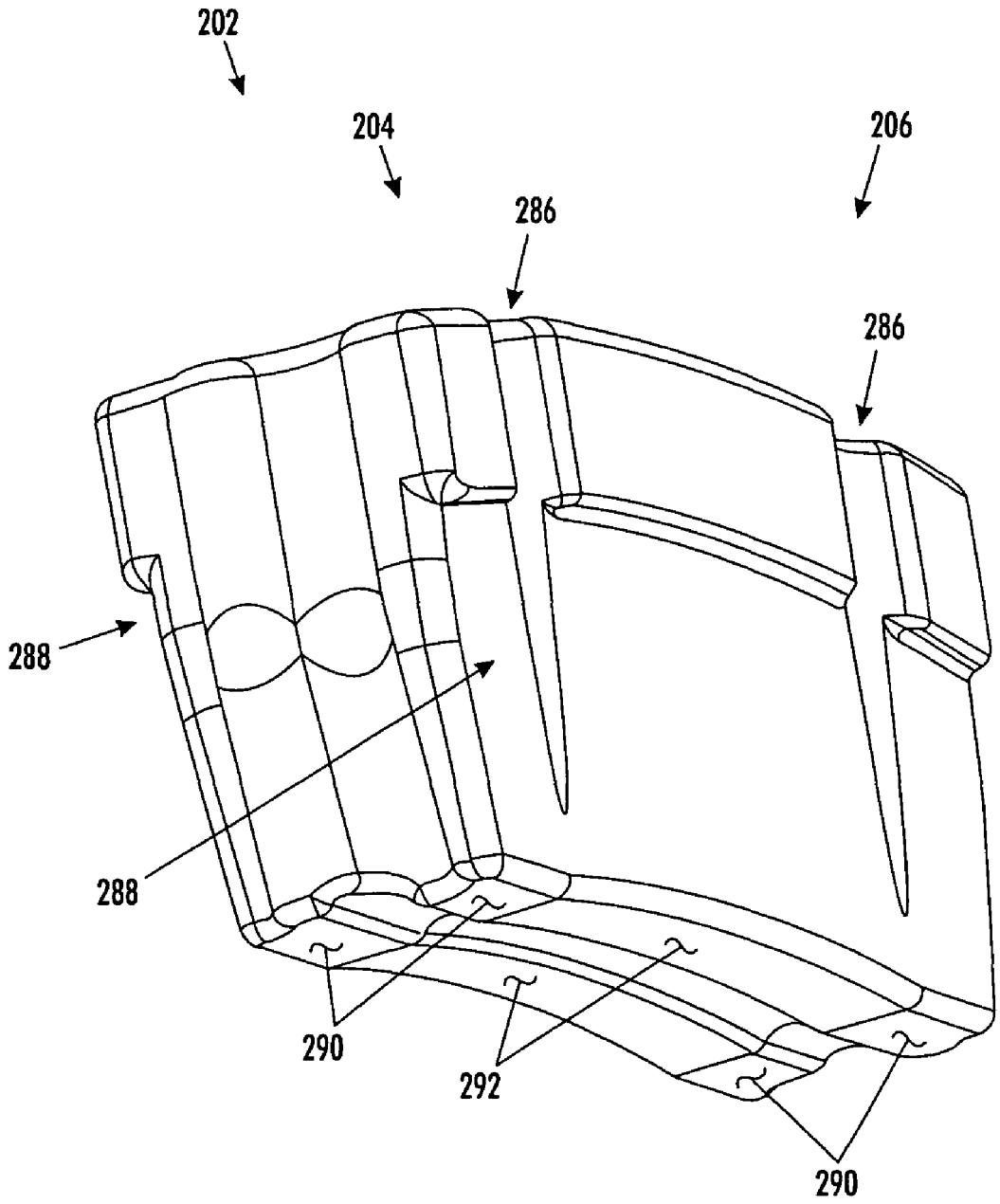
FIG. 7 is a perspective view of a solid ink stick for use with the guide assembly for advancing the ink sticks of the solid ink delivery system of FIG. 7 toward the print heads of the printer.

Referring now to FIG. 7, stick 206 for use with the printer 202 of FIGS. 2-5 is shown in greater detail. The stick 206 as is shown in FIG. 6 includes a series of vertical keying features used, among other things, to differentiate sticks of different colors and different printer models. The stick keying features are used to admit or block insertion of the ink through the keyed insertion opening of the ink delivery system 304. The stick 206 further includes a series of horizontal shaped features 288 for guiding, supporting or limiting feed of the ink stick 206 along the chute 208 feed path. It should be appreciated that keying and shaped features can be configured to accomplish the same functions with a horizontal or other alternate loading orientation.

Openings may be formed in a secondary component affixed to the chute and may employ size, shape and keying features exclusively or in concert with features of the chute to admit or exclude ink shapes appropriately. For convenience, the insertion and keying function in general will be described as integral to the chute 208.

The solid ink stick 206, as shown in FIG. 7, includes two spaced-apart pairs of spaced-apart flat portions 290, one pair on each end of the stick 206, for accommodating the linear portions of the ink feed path, as well as a centrally located pair of spaced apart arcuate portions 292, to accommodate the curved or arcuate portion of solid ink prescribed path 210. The ink stick groove 350 likewise has linear and arcuate portions.

Referring now to FIG. 8, the solid ink stick 206 is shown in position on a linear portion of the belt 216 of the ink delivery system 204 of the printer 202. The stick 206 contacts the belt 216 at the end portions 290 of the stick 206 and the groove 250 formed in the stick 206 cooperates with the belt 216 to advance the stick 206. As shown in FIG. 8, the stick 206 is arcuate or curved along longitudinal axis 294.

Referring to FIG. 9, the stick 206 is shown in position along an arcuate portion of the belt 216. As shown in FIG. 9, the central arcuate portion 292 of the solid ink stick 206 engages with the belt 216.

Figure 10:
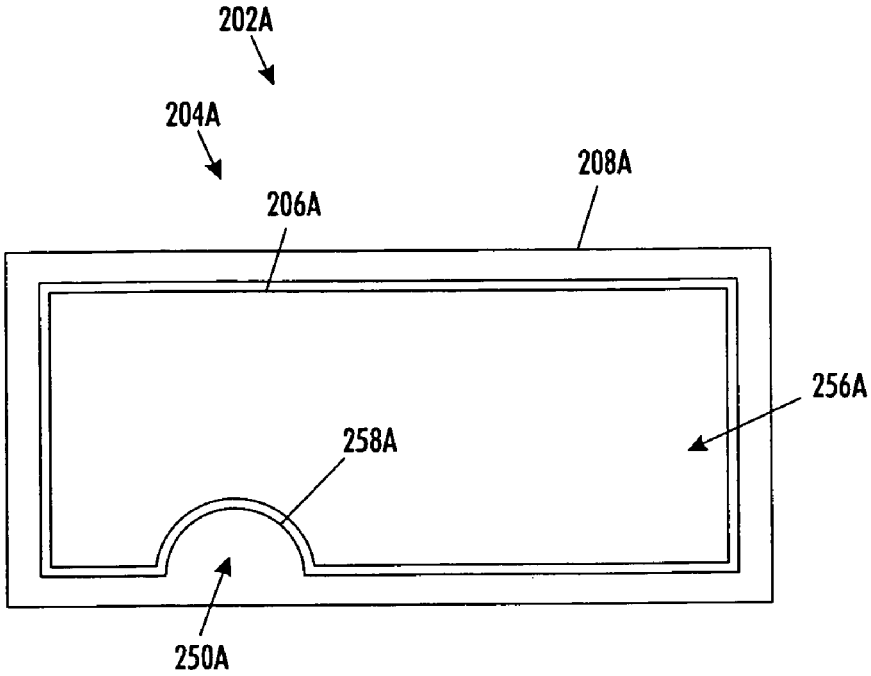
FIG. 10 is a cross sectional view of a drive member and chute of a solid ink delivery system for use in a printing machine with the drive member being not centrally positioned with respect to the chute and the ink stick according to another embodiment.

Referring now to FIG. 10, yet another embodiment is shown as solid ink printer 202A which utilizes a solid ink delivery system 204A. The ink delivery system 204A is similar to the ink delivery system 204 of FIGS. 2-6 except that the ink delivery system 204A includes a solid ink stick 206A which has a non centered stick belt guide 250A.

Figure 11:
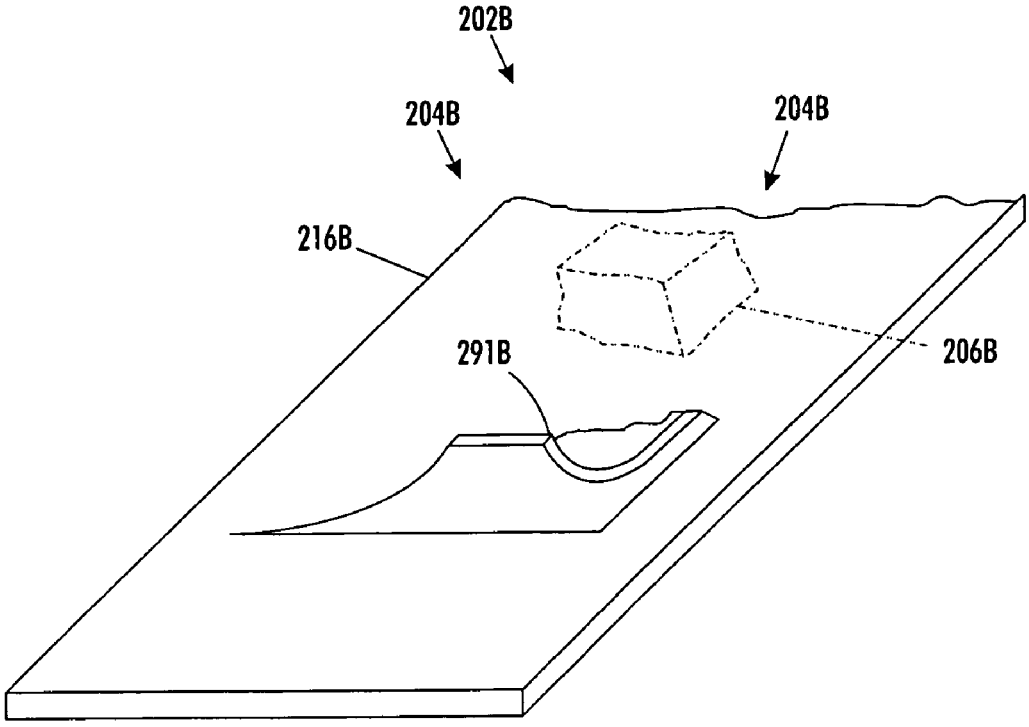
FIG. 11 is a perspective view of a flat drive member with a cog for use in a solid ink delivery system of a printing machine according to another embodiment.

Referring now to FIG. 11, yet another embodiment is shown as solid ink printer 202B which includes a solid ink delivery system 204B which includes a belt 216B which has a rectangular cross section or is flat. It should be appreciated that the belt 216B may include cogs 291B which are formed on a surface of the belt 216B for contact with the sticks 206B.

Figure 12:
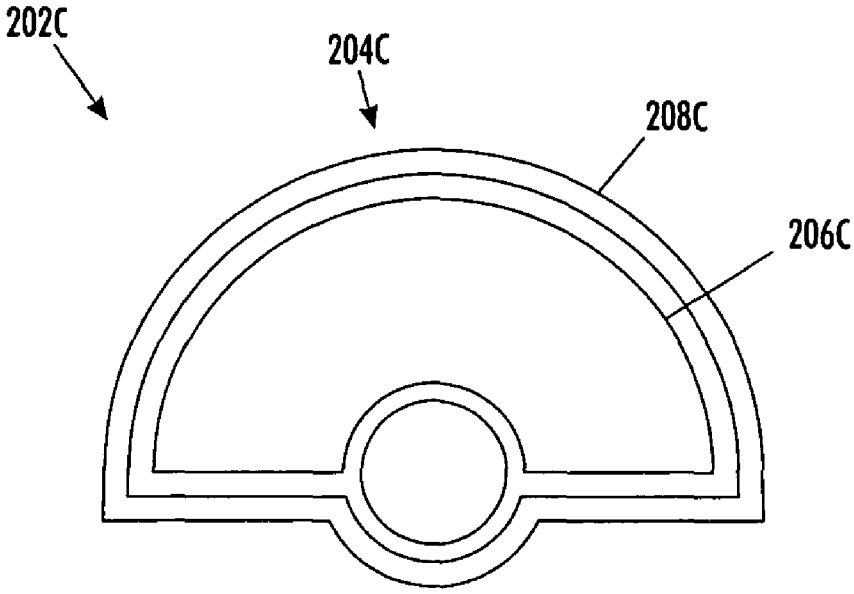
FIG. 12 is a cross sectional view of a D-shaped chute with a drive member of a solid ink delivery system for use in a printing machine according to another embodiment.

Referring now to FIG. 12, yet another embodiment, is shown as solid ink printer 202C which includes solid ink delivery system 204C which is different than the ink delivery system 204 of FIGS. 2-6 in that the ink delivery system 204C includes a chute 208C which is semi-circular and has a stick 206C which mates with the chute 208C.

Figure 13:
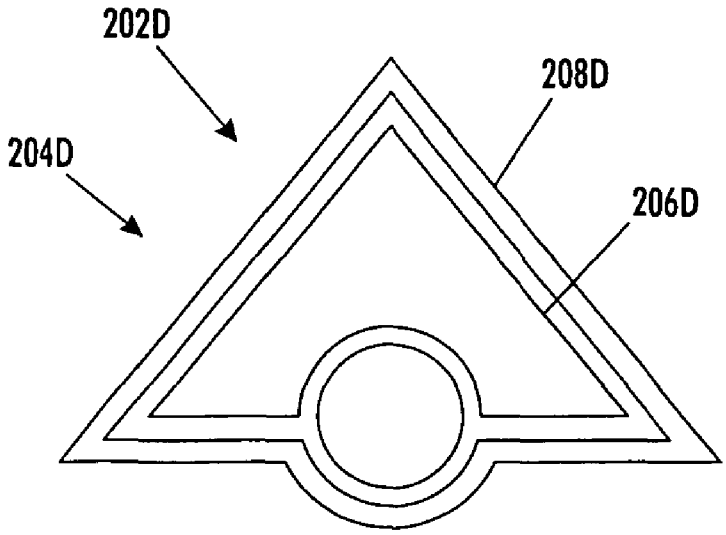
FIG. 13 is a cross sectional view of a triangular-shaped chute with a drive member of a solid ink delivery system for use in a printing machine according to another embodiment.

Referring now to FIG. 13, another embodiment is shown as solid ink printer 202D which includes a solid ink delivery system 204D which is different than the ink delivery system 204 of FIGS. 7-14 in that ink delivery system 204D includes a chute 208D which is triangular. The triangular chute 208D receives a triangular stick 206D.

Figure 14:
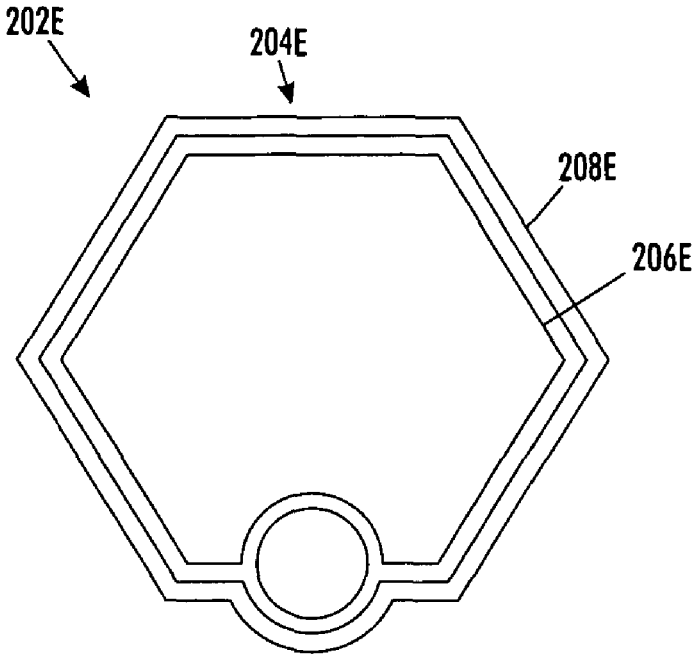
FIG. 14 is a cross sectional view of a of a hexagonal-shaped chute with a drive member of a solid ink delivery system for use in a printing machine according to another embodiment.

Referring now to FIG. 14, yet another embodiment is shown as solid ink printer 202E which includes a solid ink delivery system 204E which is different than the ink delivery system of 204 of FIGS. 7-14 in that the ink delivery system 204E includes a chute 208E which is hexagonal and cooperates with a hexagonal stick 206E.

Figure 15:
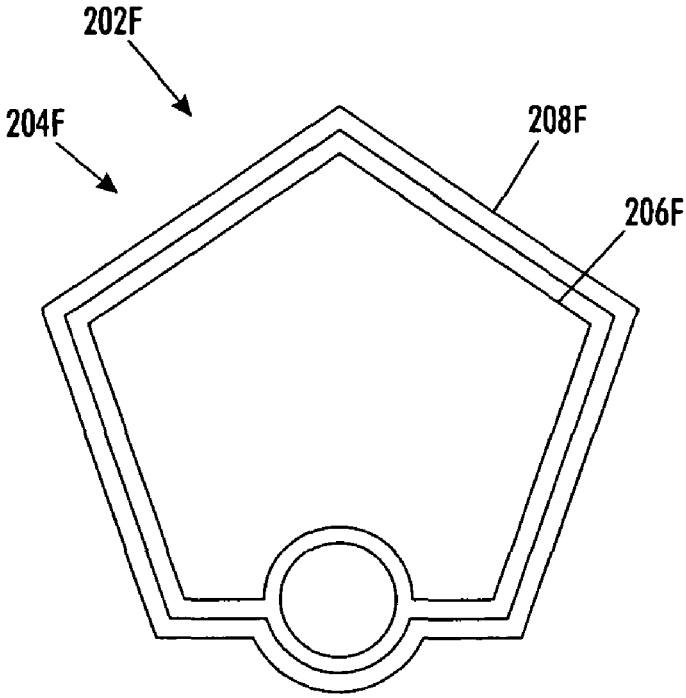
FIG. 15 is a cross sectional view of a of a pentagonal-shaped chute with a drive member of a solid ink delivery system for use in a printing machine according to another embodiment.

Referring now to FIG. 15, yet another embodiment is shown as solid ink printer 202F which includes a solid ink delivery system 204F which is different than the ink delivery system 204 of FIGS. 7-14 in that the ink delivery system 204F includes a chute 208F which is pentagonal and cooperates with a stick 206F which is also pentagonal.

The chute configuration examples shown in the various alternative embodiments are depicted as fully matching the ink shape at least in one sectional axis. The chute need not match the ink shape in this fashion and need not be completely encircling. One or more sides may be fully or partially open or differently shaped. The side surfaces of the chute do not need to be continuous over the chute length. The chute need only provide an appropriate level of support and/or guidance to complement reliable loading and feeding of ink sticks intended for use in any configuration.

Figure 16:
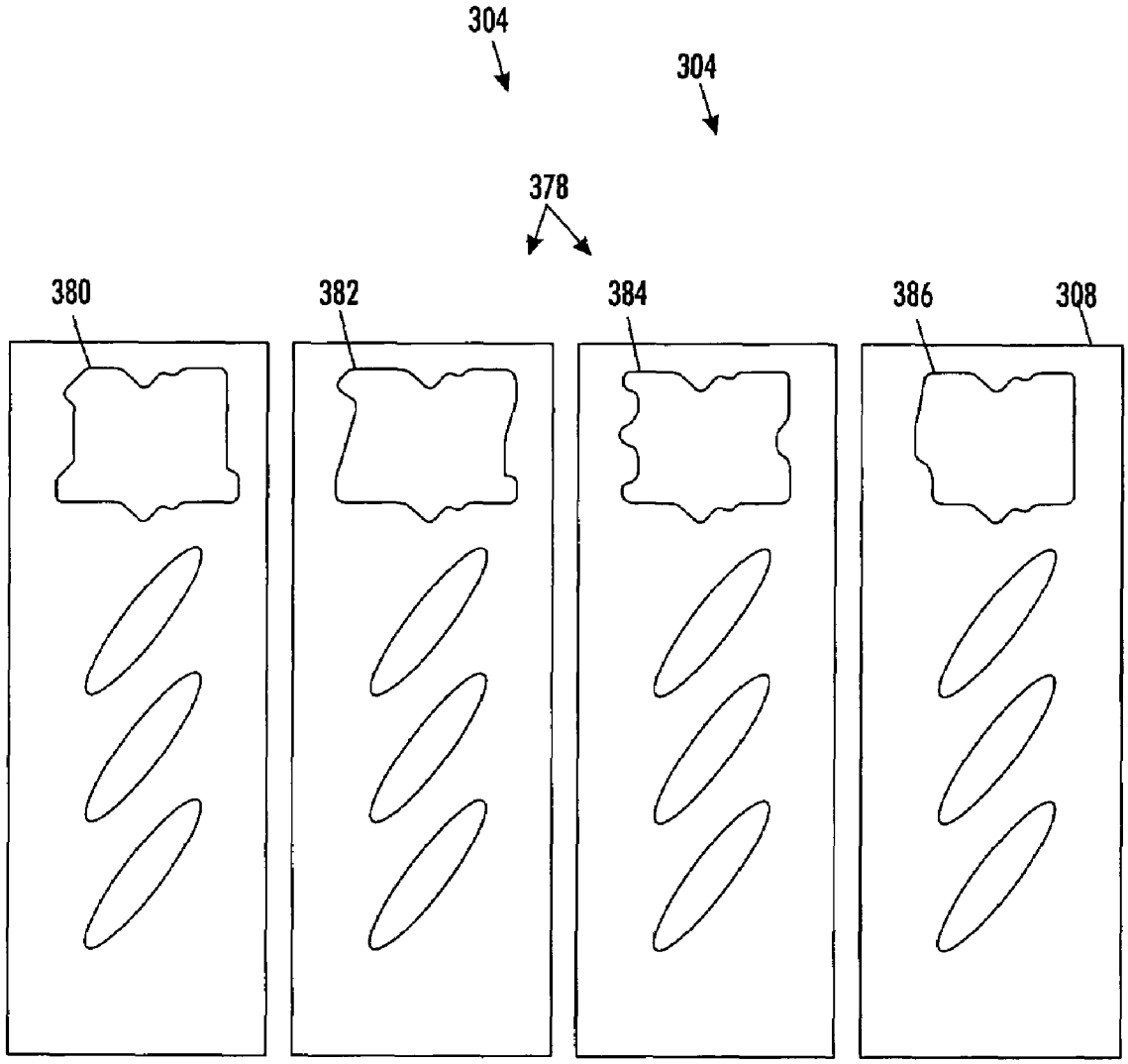
FIG. 16 is a plan view of keyed entry openings for receiving black, cyan, magenta and yellow solid ink sticks for use in a printing machine according to another embodiment.

Referring now to FIG. 16, yet another embodiment is shown as solid ink printer 302 which includes a solid ink delivery system 304 which is different than the ink delivery system of 204 of FIGS. 2-6 in that the ink delivery system 304 includes a chute 308 which includes separate keyed ends 378 for each color of solid ink. For example the chute 308 includes a black keyed end 380, a cyan keyed end 382, a magenta keyed end 384, and a yellow keyed end 386. Each of the separate keyed ends has a different shape to accommodate a unique ink stick (not shown) that can only be loaded in that specific color keyed end 378.

Figure 17:
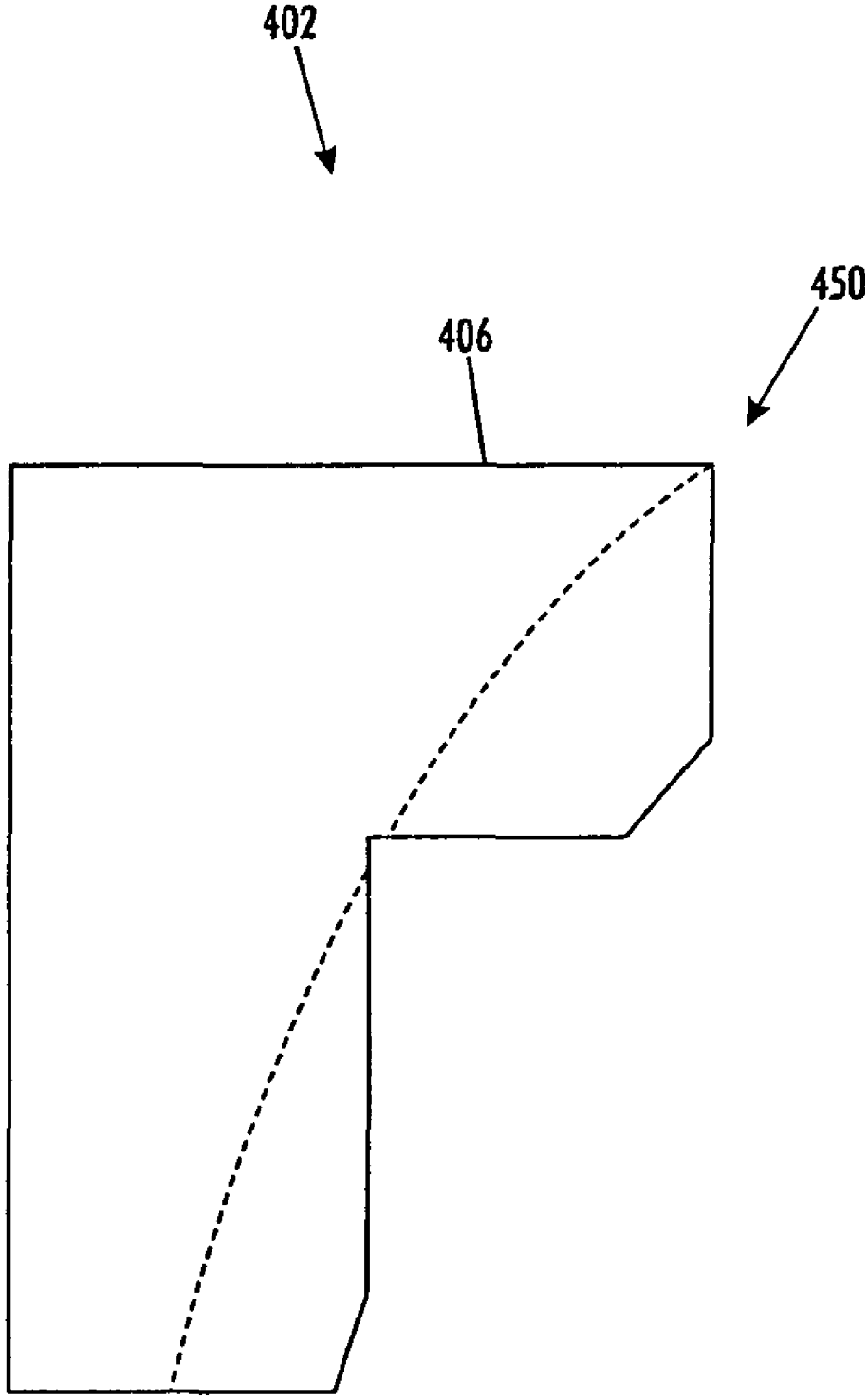
FIG. 17 is a plan view of an L-shaped solid ink stick according to another embodiment for use in a solid ink delivery system of a solid ink printer for delivering solid ink sticks to printheads of the printer.

Referring now to FIG. 17, yet another embodiment is shown as solid ink printer 402 which includes a solid ink stick 406 which is different than the stick 206 of FIGS. 2-6 in that stick 406 has an L shape to accommodate curved portions of a chute. A groove 450 is formed in the stick 406 cooperates with the belt to advance the stick 406 along its path to the melting units.

Figure 18:
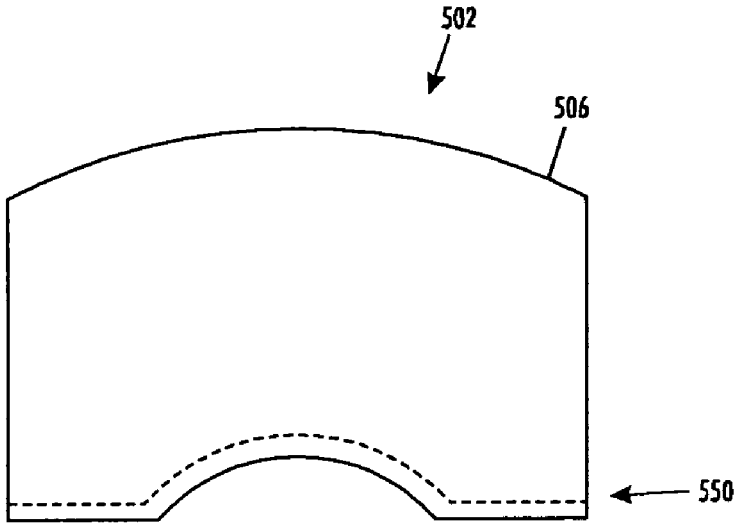
FIG. 18 is plan view of a C-shaped solid ink stick according to yet another embodiment for use in a solid ink delivery system of a solid ink printer for delivering solid ink sticks to printheads of the printer.
Figure 19:
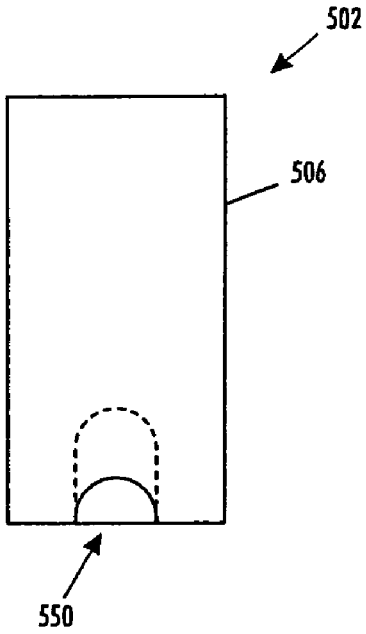
FIG. 19 is an end view of FIG. 18.

Referring now to FIGS. 18 & 19, yet another embodiment is shown as solid ink printer 502 which includes a solid ink stick 506 which is different than the stick 206 of FIGS. 2-6 in that stick 506 has an C shape to accommodate curved portions of a chute. A groove 550 is formed in the stick 506 cooperates with the belt to advance the stick 506 along its path to the melting units.

Variations and modifications of the solid ink sticks are possible, given the above description. However, all variations and modifications which are obvious to those skilled in the art to which the solid ink sticks pertain are considered to be within the scope of the protection granted by this Letters Patent.

What is claimed is:

1. A solid ink stick comprising:

a body having a bottom surface extending from a front face to a rear face of the body, the body having a longitudinal axis that extends from the front face to the rear face, the bottom surface including first and second planar portions, the first and second planar portions being separated from one another by a predetermined distance along the longitudinal axis of the body; and a groove extending along the bottom surface through the first and second planar portions from a position proximate the first planar portion and the second planar portion, a portion of the groove extending between the first and the second planar portions being arcuate in a direction parallel to the longitudinal axis and the bottom surface of the body being arcuate on each side of the groove extending between the first and the second planar portions.

2. The stick of claim 1, wherein the groove has a generally semicircular cross section in a direction normal to the longitudinal axis of the body.

3. The stick of claim 1, wherein at least a portion of the body is arcuate in the direction parallel to the longitudinal axis along a portion of a top surface of the body from the front face to the rear face.

4. The stick of claim 1, wherein the groove is centrally positioned between two side faces of the body.

5. A solid ink stick comprising:

a body having a bottom surface extending from a front face to a rear face of the body, the body having a longitudinal axis that extends from the front face to the rear face, the bottom surface including first and second planar portions, the first and second planar portions being separated from one another by a predetermined distance along the longitudinal axis of the body; and a groove extending along the bottom surface through the first planar portion and the second planar portion, a portion of the groove extending between the first and the second planar portions being arcuate in a direction along the longitudinal axis and the bottom surface of the body being arcuate on each side of the groove extending through the first and the second planar portions.

6. The stick of claim 5, wherein the groove has a generally semicircular cross section in a direction normal to the longitudinal axis of the body.

7. The stick of claim 5, wherein at least a portion of the body is arcuate along a portion of a top surface of the body from the front face to the rear face.

8. The stick of claim 5, wherein the groove is centrally positioned between two side faces of the body.

* * * * *